US007036753B2

(12) United States Patent
Huffman

(10) Patent No.: US 7,036,753 B2
(45) Date of Patent: May 2, 2006

(54) INTERNAL MIXING ATOMIZING SPRAY NOZZLE ASSEMBLY

(75) Inventor: David C. Huffman, Merrimack, NH (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 10/674,029

(22) Filed: Sep. 29, 2003

(65) Prior Publication Data

US 2004/0222317 A1 Nov. 11, 2004

(30) Foreign Application Priority Data

May 7, 2003 (WO) ..... PCT/US03/14186

(51) Int. Cl.
*B05B 7/06* (2006.01)

(52) U.S. Cl. ..... 239/432; 239/427; 239/429; 239/430; 239/431; 239/434

(58) Field of Classification Search ..... 239/432, 239/427, 429, 430, 431, 434, 416.5, 433, 239/434.5, 423, 424.5, 425, 426
See application file for complete search history.

(56) References Cited

U.S. PATENT DOCUMENTS 4,073,436 A * 2/1978 Behr ..... 239/8
4,195,779 A 4/1980 Auclair et al.
4,699,587 A * 10/1987 Shimoda et al. ..... 431/354
5,553,785 A * 9/1996 Haruch ..... 239/432
5,732,885 A * 3/1998 Huffman ..... 239/416.5
5,868,321 A * 2/1999 Haruch ..... 239/399
5,899,387 A 5/1999 Haruch
6,267,301 B1 7/2001 Haruch

* cited by examiner

*Primary Examiner*—David A. Scherbel
*Assistant Examiner*—Darren Gorman
(74) *Attorney, Agent, or Firm*—Leydig, Voit & Mayer Ltd.

(57) ABSTRACT

A nozzle for atomizing and spraying liquid is provided. The nozzle includes a longitudinal liquid flow passageway that terminates in a liquid orifice for directing a stream of liquid along a predetermined axis. A plurality of intersecting, transverse passageways extend perpendicular to and intersect the predetermined axis. Each of the transverse passageways terminates at either end in an outlet. The transverse passageways define a first impingement surface downstream of the liquid orifice for breaking up a stream of liquid impinging thereon into a laterally spreading dispersion which disperses through the transverse passageways. An air annulus is arranged in surrounding relation to the outlets of the transverse passageways and oriented to discharge air in a downstream direction so as to strike the fluid dispersed through the outlets of the transverse passageways. An expansion chamber is arranged downstream of the transverse passageways and air annulus. The expansion chamber communicates with a nozzle discharge orifice.

12 Claims, 2 Drawing Sheets

INTERNAL MIXING ATOMIZING SPRAY NOZZLE ASSEMBLY

FIELD OF THE INVENTION

The present invention relates generally to spray nozzle assemblies, and more particularly, to spray nozzle assemblies in which liquid is atomized by pressurized air prior to discharge from the nozzle.

BACKGROUND OF THE INVENTION

Spray nozzle assemblies are known which utilize pressurized air for breaking down liquid into relatively small particle sizes. Such nozzle assemblies have particular utility in gas scrubbing applications, where ammonia or urea is sprayed into a discharging stream of combustion gases for removing nitric oxide or other combustion by-products. A problem with such prior spraying nozzles is that relatively high pressurized air is required to achieve adequate liquid particle break-down and atomization, which increases capital and operating costs.

OBJECTS AND SUMMARY OF THE INVENTION

It is an object of the present invention to provide a spray nozzle assembly which can operate at lower air pressures for effectively atomizing liquid sprays for use in gas scrubbing or other applications in which the discharging spray must have a fine liquid particle distribution.

To this end, a nozzle for atomizing and spraying liquid is provided. The nozzle includes a longitudinal liquid flow passageway that terminates in a liquid orifice for directing a stream of liquid along a predetermined axis. A plurality of intersecting, transverse passageways extend perpendicular to and intersect the predetermined axis. Each of the transverse passageways terminates at either end in an outlet. The transverse passageways define a first impingement surface downstream of the liquid orifice for breaking up a stream of liquid impinging thereon into a laterally spreading dispersion which disperses through the transverse passageways. An air annulus is arranged in surrounding relation to the outlets of the transverse passageways and oriented to discharge air in a downstream direction so as to strike the fluid dispersed through the outlets of the transverse passageways. An expansion chamber is arranged downstream of the transverse passageways and air annulus. The expansion chamber communicates with a nozzle discharge orifice.

DETAILED DESCRIPTION OF THE ILLUSTRATED EMBODIMENT

Figure 1:
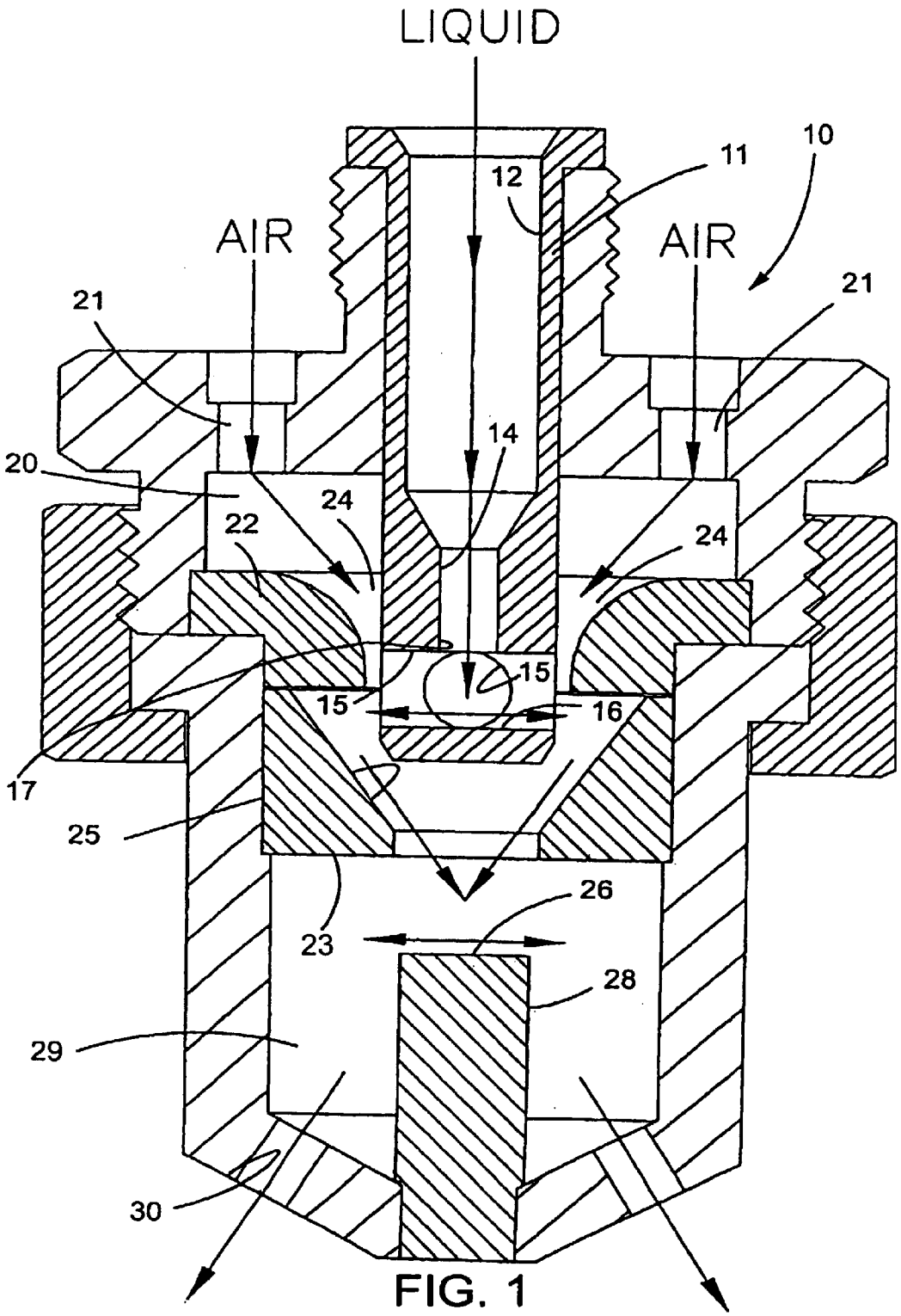
FIG. 1 is a vertical section of an illustrative spray nozzle assembly in accordance with the present invention.

Referring now more particularly to FIG. 1 of the drawings, there is shown a multi-stage spray nozzle assembly 10 in accordance with the invention. The spray nozzle assembly 10 is an improvement upon, however similar in certain respects, to the multi-stage air atomizing spray nozzle assembly shown in U.S. Pat. No. 5,732,885, assigned to the same assignee as the present application, the disclosure of which is incorporated herein by reference. In the illustrated embodiment, the nozzle includes a multi-part body that includes a main body portion with an upwardly extending and externally threaded neck defining an inlet that is adapted to attach to a line for delivering pressurized fluid to the nozzle. A nozzle tip is positioned below the main body portion and is removably attached thereto by a coupling nut. The one or more discharge orifices of the nozzle are formed in the nozzle tip as described in greater detail below.

The body of the spray nozzle assembly 10 includes a liquid flow tube 11 having a central longitudinally extending liquid passageway 12 which channels liquid directed into the nozzle through the nozzle inlet into a smaller diameter longitudinal passageway 14. The smaller diameter longitudinal passageway communicates via a fluid orifice 17 with a plurality of equally spaced, intersecting transverse passageways or cross holes 15. In this case, each of the cross holes 15 extends perpendicular to and intersects the centerline of the longitudinal passageways 12, 14 of the liquid flow tube. A liquid stream introduced into the liquid passageway 12 is accelerated through the reduced diameter passageway 14, striking an end wall 16 of a chamber formed by the intersecting cross holes 15. As the accelerating liquid impinges the end wall 16, it is directed outwardly in a semicircular fan or sheet of atomized liquid particles discharging generally perpendicular to the longitudinal axis of the passageways 12, 14. It is important that the reduced diameter liquid passageway 14 be no larger in diameter than the cross holes 15, and preferably smaller in diameter.

To further enhance liquid particle breakdown, the spray nozzle assembly includes a second stage which includes an inner chamber 20 which receives pressurized air from a plurality of inlet passageways 21 and an air guide 22 that defines an inwardly flared radiused passageway or air annulus 24 that channels the airflow stream in order to create and direct a high velocity annular air curtain parallel to the longitudinal axis of the nozzle assembly. This annular pressurized air stream strikes the atomized fan-shaped liquid spray discharging from the first-stage cross holes 15 to further atomize the liquid particles.

In keeping with the invention, the spray nozzle assembly 10 has a third-stage comprised of a mixture guide 23 that defines an inwardly tapered funnel 25 for directing the atomized particles from the second stage into a high velocity central flow stream. This stream is directed toward and strikes a flat end face 26 of an impingement pin 28 that projects upwardly from the lower end of the nozzle tip. The impingement pin further breaks down and reduces the particle size of the atomized mixture. The mixture is then allowed to expand in an expansion chamber 29 about the impingement pin 28 to prevent the liquid particles in the atomized mixture from commingling together and reforming into larger particles.

Finally, the nozzle assembly includes a fourth stage comprised of a multiplicity of spray tip discharge orifices 30 which exit the expansion chamber in circumferentially spaced relation to the impingement pin 28. In the illustrated embodiment, the discharge orifices 30 are angled outwardly relative to the longitudinal axis of the nozzle assembly. As the air flow mixture discharges through the multiplicity of orifices 30 into the atmosphere, the liquid particles atomize still further due to the release pressure.

The four-stage spray nozzle assembly 10 has been found to effectively atomize liquid sprays, and particularly ammonia and urea liquid sprays, into combustion gas streams with lower pressurized air requirements. By way of specific example, a nozzle having the construction illustrated in FIG.

1 and including six discharge orifices and four cross holes has provided good operating results with the following relative dimensions:

| Nozzle Size (GPM) | Spray Angle | Discharge Orifice 30 Area (in.$^2$) | Liquid Orifice 17 Area (in.$^2$) | Cross Hole 15 Area (in.$^2$) | Air Annulus 24 Area (in.$^2$) |
|---|---|---|---|---|---|
| 0.75 | 55° | 0.0123 | 0.0123 | 0.0278 | 0.0411 |

The areas noted are for each discharge orifice 30 and each cross hole 15.

Figure 2:
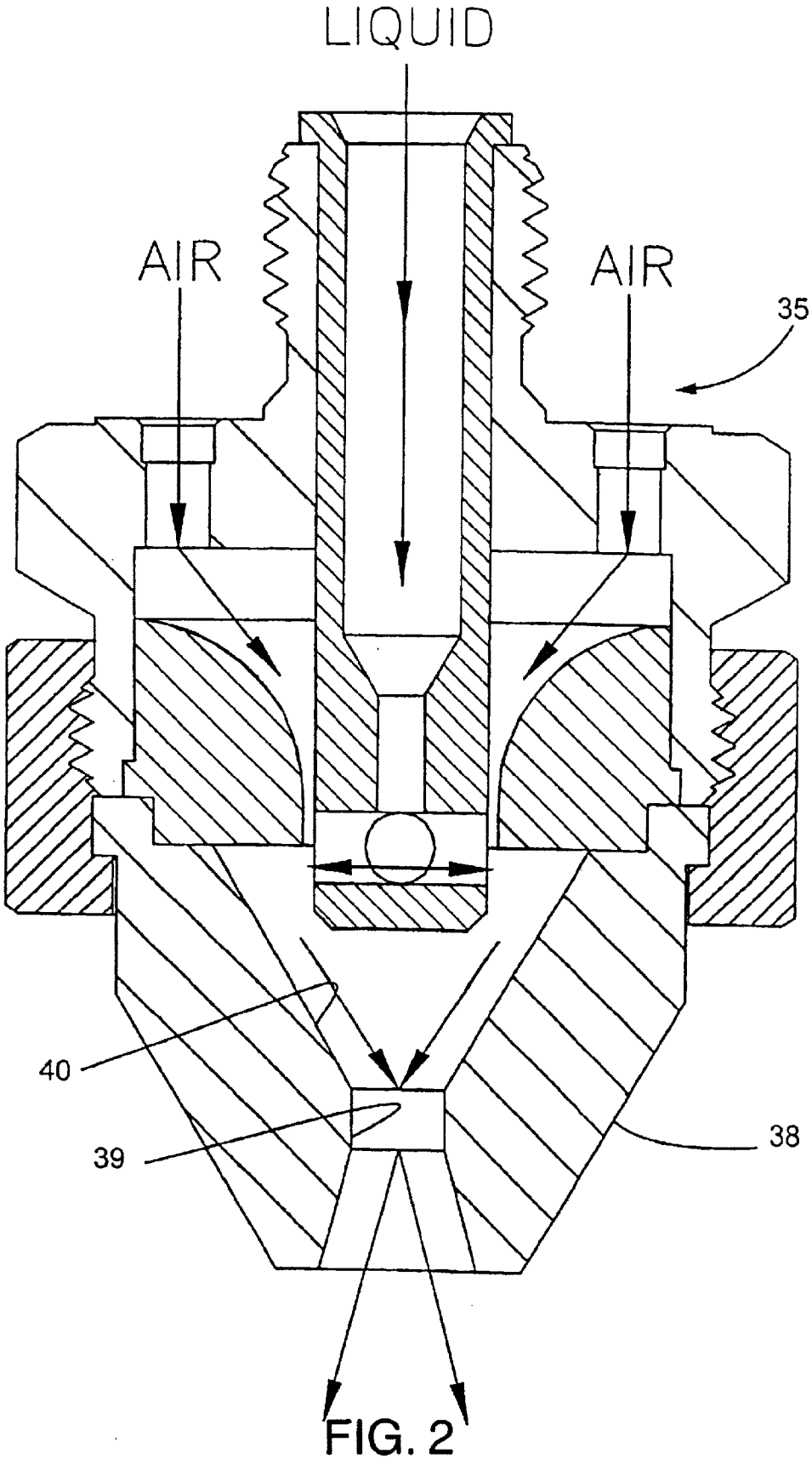
FIG. 2 is a vertical section of an alternative embodiment of a spray nozzle assembly in accordance with the invention.

Referring now more particularly to FIG. 2, there is shown an alternative embodiment of spray nozzle assembly 35 according to the invention which includes first and second mixing stages, generally similar to the spray nozzle assembly shown in FIG. 1, but without a multi-discharge orifice spray tip and an impingement pin. Instead, the spray nozzle assembly 35 has a spray tip 38 with a central discharge orifice 39 and an inwardly converging air guide chamber 40 which directs and accelerates the atomized liquid through the central discharge orifice 39.

Even without an impingement pin such as in the FIG. 1 embodiment, the multi mixing stage nozzle assembly 35, comprising the spray tube 11 with cross holes 15 and the inwardly flared air guide 22 and air annulus 24 and the inwardly tapered mixing chamber 40, has been found to effectively atomize urea, at relatively low air pressures for efficient usage in gas scrubbing. In fact, the spray nozzle assembly 35 of FIG. 2 has been found to be advantageously useful by spraying of urea since the inwardly tapered mixing chamber 40 communicating directly with the discharge orifice 39, enabling quick liquid spray discharge without any tendency for the urea to crystallize.

By way of specific examples, nozzles having the construction illustrated in FIG. 2 have provided good operating results with the following relative dimensions:

| Nozzle Size (GPM) | Spray Angle | Discharge Orifice 39 Area (in.$^2$) | Liquid Orifice 17 Area (in.$^2$) | Cross Hole 15 Area (in.$^2$) | Air Annulus 24 Area (in.$^2$) |
|---|---|---|---|---|---|
| 0.25 | 20° | 0.0123 | 0.005153 | 0.00694 | 0.0179 |
| 0.5 | 20° | 0.0256 | 0.0123 | 0.0278 | 0.02 |
| 0.625 | 20° | 0.0408 | 0.01 | 0.0278 | 0.02 |
| 0.75 | 20° | 0.0491 | 0.0123 | 0.0278 | 0.04411 |

The 0.5 GPM nozzle has three cross holes 15, while each of the other nozzles has four cross holes 15. The dimensions noted are for each cross hole 15.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A nozzle for atomizing and spraying liquid comprising:

a longitudinal liquid flow passageway that terminates in a liquid orifice for directing a stream of liquid along a predetermined axis;

a plurality of intersecting, transverse passageways extending perpendicular to and intersecting the predetermined axis, each of the transverse passageways terminating at either end in an outlet, the transverse passageways defining a first impingement surface downstream of the liquid orifice for breaking up a stream of liquid impinging thereon into a laterally spreading dispersion which disperses through the transverse passageways, wherein the longitudinal liquid flow passageway includes a portion having a reduced cross-sectional area relative to the remainder of the longitudinal liquid flow passageway, the reduced cross-sectional area portion being arranged at a downstream end of the longitudinal liquid flow passageway for enhancing the velocity of a liquid flowing therethrough and having a cross-sectional area less than the cross-sectional area of each of the transverse passageways;

an air annulus arranged in surrounding relation to the outlets of the transverse passageways and oriented to discharge air in a downstream direction so as to strike the fluid dispersed through the outlets of the transverse passageways; and an expansion chamber arranged downstream of the transverse passageways and air annulus, the expansion chamber communicating with a nozzle discharge orifice.

2. The nozzle according to claim 1 further including an impingement element disposed in the expansion chamber, the impingement element defining an impingement surface downstream of the transverse passageways and the air annulus.

3. The nozzle according to claim 2 wherein the expansion chamber communicates with a plurality of discharge orifices that are arranged circumferentially about the impingement element.

4. The nozzle according to claim 1 wherein the air annulus includes an inlet portion that flares inwardly in the downstream direction to enhance the velocity of air flowing therethrough.

5. A nozzle for atomizing and spraying liquid comprising:

a nozzle body including:

a longitudinal liquid flow passageway that terminates in a liquid orifice for directing a stream of liquid along a predetermined axis;

a plurality of intersecting, transverse passageways extending perpendicular to and intersecting the predetermined axis, each of the transverse passageways terminating at either end in an outlet, the transverse passageways defining a first impingement surface downstream of the liquid orifice for breaking up a stream of liquid impinging thereon into a laterally spreading dispersion which disperses through the transverse passageways;

a plurality of air inlet passages;

an air guide defining an inwardly flared, radiused air annulus for channeling pressurized air from the air inlet passages to create a high velocity annular air curtain directed in surrounding relation to the outlets of the transverse passageways so as to strike the fluid dispersed through the outlets of the transverse passageways; and an expansion chamber arranged downstream of the transverse passageways and air annulus, the expansion chamber communicating with a nozzle discharge orifice.

6. The nozzle according to claim 5 further including an impingement element disposed in the expansion chamber, the impingement element defining an impingement surface downstream of the transverse passageways and the air annulus.

7. The nozzle according to claim 6 wherein the expansion chamber communicates with a plurality of discharge orifices that are arranged circumferentially about the impingement element.

8. The nozzle according to claim 5 wherein the longitudinal liquid flow passageway includes a portion having a reduced cross-sectional area relative to the remainder of the longitudinal liquid flow passageway, the reduced cross-sectional area portion being arranged at a downstream end of the longitudinal liquid flow passageway for enhancing the velocity of a liquid flowing therethrough.

9. The nozzle according to claim 8 wherein the reduced cross-sectional area portion of the longitudinal fluid flow passage way has a cross-sectional area less than the cross-sectional area of each of the transverse passageways.

10. A nozzle for atomizing and spraying liquid comprising:

a nozzle body including:

a longitudinal liquid flow passageway that terminates in a liquid orifice for directing a stream of liquid along a predetermined axis;

a plurality of intersecting, transverse passageways extending perpendicular to and intersecting the predetermined axis, each of the transverse passageways terminating at either end in an outlet, the transverse passageways defining a first impingement surface downstream of the liquid orifice for breaking up a stream of liquid impinging thereon into a laterally spreading dispersion which disperses through the transverse passageways, wherein the longitudinal liquid flow passageway includes a portion having a reduced cross-sectional area relative to the remainder of the longitudinal liquid flow passageway, the reduced cross-sectional area portion being arranged at a downstream end of the longitudinal liquid flow passageway for enhancing the velocity of a liquid flowing therethrough and having a cross-sectional area less than the cross-sectional area of each of the transverse passageways;

an air guide defining an air annulus arranged in surrounding relation to the outlets of the transverse passageways and oriented to discharge air in a downstream direction so as to strike the fluid dispersed through the outlets of the transverse passageways; and an expansion chamber arranged downstream of the transverse passageways and air annulus, the expansion chamber communicating with a nozzle discharge orifice.

11. The nozzle according to claim 10 further including an impingement element disposed in the expansion chamber, the impingement element defining an impingement surface downstream of the transverse passageways and the air annulus.

12. The nozzle according to claim 10 wherein the expansion chamber communicates with a plurality of discharge orifices that are arranged circumferentially about the impingement element.

* * * * *